US007158886B2

(12) United States Patent
Hou et al.

(10) Patent No.: US 7,158,886 B2
(45) Date of Patent: Jan. 2, 2007

(54) AUTOMATIC CONTROL SYSTEM AND METHOD FOR BOTTOM HOLE PRESSURE IN THE UNDERBALANCE DRILLING

(75) Inventors: Xutian Hou, Dezhou (CN); Chunguo Yang, Dezhou (CN); Bingtang Gao, Dezhou (CN); Yijin Zeng, Dezhou (CN); Caixuan Guo, Dezhou (CN); Jianlong Zhang, Dezhou (CN)

(73) Assignees: China Petroleum & Chemical Corporation, Beijing (CN); Exploration & Production Research Institute, Sinopec, Beidaobu (CN)

( * ) Notice: Subject to any disclaimer, the term of this patent is extended or adjusted under 35 U.S.C. 154(b) by 57 days.

(21) Appl. No.: 10/976,544

(22) Filed: Oct. 29, 2004

(65) Prior Publication Data

US 2005/0096848 A1 May 5, 2005

(30) Foreign Application Priority Data

Oct. 31, 2003 (CN) ..... 200310103433

(51) Int. Cl.
*E21B 44/00* (2006.01)

(52) U.S. Cl. ..... 702/9

(58) Field of Classification Search ..... 702/9, 702/12, 13; 703/10

See application file for complete search history.

(56) References Cited

U.S. PATENT DOCUMENTS 5,842,149 A 11/1998 Harrell et al.
6,035,952 A 3/2000 Bradfield et al.
6,367,566 B1 4/2002 Hill
6,607,042 B1 8/2003 Hoyer et al.
2002/0112888 A1 8/2002 Leuchtenberg
2003/0139916 A1 * 7/2003 Choe et al. ..... 703/10

FOREIGN PATENT DOCUMENTS

CN 1339650 3/2002

OTHER PUBLICATIONS

Liu Gang, *Chines Petroleum Mechanism, 29(5)*, 2001 (Abstract).

* cited by examiner

*Primary Examiner*—Donald McElheny, Jr.
(74) *Attorney, Agent, or Firm*—Marshall, Gerstein & Borun LLP

(57) ABSTRACT

This invention provides an automatic control system and method for bottom hole pressure (BHP) in the underbalanced drilling. It relates to a computer automatic control technology. The automatic control system according to the invention includes a processing module for the BHP based on the mechanisms of hydraulics. The BHP in the underbalanced drilling is calculated from the acquired standpipe pressure (SPP), the calculated circulating pressure loss in the drilling tools, drill bit pressure drop and the fluid colunm pressure in the drill string. The resulting BHP is then compared with the set pressure value of the system. In case that the BHP is higher or lower than the set pressure, an instruction to regulate throttle valve opening will be issued in order to bring the BHP back to the set pressure range and complete BHP monitoring and control.

12 Claims, 4 Drawing Sheets

AUTOMATIC CONTROL SYSTEM AND METHOD FOR BOTTOM HOLE PRESSURE IN THE UNDERBALANCE DRILLING

CROSS-PEFERENCE TO RELATED APPLICATION

This application claims the benefit of Chinese Patent Application Ser. No. 200310103433.1, filed Oct. 31, 2003.

FIELD OF THE INVENTION

This invention relates to pressure control technology for underbalance drilling, more specifically, to automatic control system and method for bottom hole pressure (BHP) in the underbalance drilling (UBD) with a liquid phase.

BACKGROUND OF THE INVENTION

In current conventional drilling process, overbalanced drilling technology tends to be used, that is, the BHP during drilling operation (drilling fluid column pressure plus circulating pressure drop) is higher than formation pore pressure. The advantage of this technology is its high safety. However, because drilling fluid pressure is higher than formation pore pressure, formation pollution is inevitable, in that (1) mud filtrates invade into formation and are hydrated with clay in the formation, which results in clay swelling, dispersion and migration and plugging of pore throats; (2) the chemical reaction between mud filtrates and formation fluids leads to water blocking, emulsification, wettability reversal and solid precipitations resulting in plugging of pore throats; (3) solid precipitation from mud plugs pore throats directly. Due to the above reasons, in onsite drilling operation, although good oil and gas shows are observed before well completion and post-completion effect reaction is strong even with well kick and well blowout, the effect for well completion testing are very poor and production (if any) is rather low or declines rapidly owing to reservoir pollution and other reasons. In such case, the good oil and gas shows in drilling process make the decision makers reluctant to give up the opportunity, thus wells are drilled repeatedly, resulting in waste of huge investment, delay or even missing the discovery of new oilfields. Furthermore, the pressure difference can exert negative influence on penetration rate, such as (1) influence on rock strength: the bigger the pressure difference is, the higher the rock strength is and the harder to crash the rock; (2) influence on hole bottom cleaning: higher pressure difference tends to result in chip hold down effect and affects penetration rate, so the higher the pressure difference is, the lower the penetration rate is. Therefore, reducing pressure difference is one way to improve penetration rate.

As one of the top 10 leading petroleum-engineering technologies in the 20th century, underbalance drilling (UBD) has been experienced rapid development abroad as an emerging technology in recent years. It is designed to avoid those serious engineering accidents occurred in overbalanced drilling operation including lost of well, improve penetration rate and mitigate formation damage. It leads to breakthrough in well drilling theory and is the inevitable result of the transition of drilling operation from overbalanced drilling, balanced drilling to underbalance drilling.

UBD is characterized by the utilization of special equipment (rotary blowout preventer) and process to conduct underbalance drilling at borehole bottom, i.g. Drilling while jetting. The key point for UBD is to keep bottom hole pressure (BHP) lower than formation pore pressure or formation pressure within a proper range (i.e., set negative pressure value) during drilling operation. However, in actual drilling operation, BHP can never be kept constant as a result of the fluctuation of wellhead pressure and bottom hole pressure, mainly because formation fluid enters into the hole, especially formation gas flows into the wellbore under the negative pressure at hole bottom and pump-in flow rate varies. At present, BHP is indirectly estimated onsite from the amount of oil and gas production while drilling. For example, if oil and gas production is too high, BHP is probably too low and the negative pressure is too high; on the contrary, if oil and gas production is too low, BHP is probably too higher, which may result in overbalanced drilling. Experiences have proven that manual adjustment of throttle valve to change casing pressure (CP) can indirectly regulate BHP and keep casing pressure within a proper range. However, as manual adjustment has the problems of low accuracy and efficiency, and especially this method of estimating the BHP and adjusting the casing pressure depends on the experiences and competence of the operator in a high degree, and no objective parameters can be directly referred. Any minor mistake in operation may result in overbalanced pressure at hole bottom, which may miss the point of underbalance drilling or even trigger drilling accident in case that the negative pressure is too high.

On the basis of the theory of manual UBD pressure adjustment, Chinese Pat. No. 01136291.X discloses a choke pressure (casing pressure) automatic control system for UBD. It is characterized by collecting dynamic modeling signals (standpipe pressure, casing pressure, etc.) and converting the signals into pressure data by computer, then controlling the pressure following the set casing pressure and standpipe pressure in order to maintain the casing pressure within the set pressure range. Although the accuracy and efficiency are improved when comparing with manual adjustment, the essence of the system is simply to replace manual work with computer, the basic theory and the parameters for reference and adjustment are basically the same as manual adjustment, therefore the same problems with manual adjustment still remain.

At present, the technology for manufacturing rotary blowout preventer specially used for UBD manufacturing tends to mature globally and several Chinese petroleum mechanical factories are also developing rotary blowout preventers, but none of them are equipped with corresponding pressure automatic control system. Furthermore, because of the differences in geology and terrain, the UBD operations conducted abroad usually involve injection of gas, that is, gas and drilling fluid (mud) are injected into drilling tools simultaneously. In UBD with gas injection, BHP is regulated by adjusting the amount of injected gas and injected fluid. Domestic UBD operations, however, are mostly UBD with a single liquid phase, i.e., only drilling fluid is injected into drilling tools. Therefore, the pressure control method used by foreign countries in UBD with gas injection cannot be mechanically applied in China.

SUMMARY OF THE INVENTION

BHP control is the key for the success of UBD operation. Improper BHP control will result in overbalanced drilling and miss the point for UBD or even trigger drilling accident like losing control to wellhead as a result of excessively high negative pressure.

This invention specifically targets at UBD with a liquid phase, which involves injection of a pure liquid phase (mud or drilling fluid) into the drilling pipe. As shown in FIG. 2 attached, drilling pipe 15 is hollow for injection of drilling fluid. Annulus 14 represents the space between drilling pipe and borehole wall. Drilling fluid injected through drilling pipe 15 jets out from drill bit and returns to the surface through annulus 14. Although it is possible to derive BHP 13 from annulus 14 and casing pressure 12, it is very difficult to accurately and easily calculate BHP 13 from outlet pressure because the fluids in annulus 14 are multiple phase flow including not only drilling fluid, but also oil, gas and cuttings carried up from oil and gas layers, and the complex factors influencing multiple phase flow tend to result in significant calculation errors.

The inventor believes that the hollow space provided by annulus and drill pipe forms a channel similar to a U-type pipe shown in FIG. 3. In drill pipe 15, BHP 13 can be derived from a standpipe pressure 16, a pressure drop within drill tool, drill bit pressure drop and liquid column pressure. In addition, since the fluid in drill pipe 15 for UBD with a liquid phase is a pure liquid phase, BHP 13 can be accurately calculated through well-known hydraulic model with much small error when comparing with multiphase flow model.

In accordance with the theory of kinetic equilibrium between the annulus and the drill pipe, studying the relationship between BHP and other drilling parameters, and substantially thinking all kinds of factors influencing BHP in fluid phase UBD into account, the inventor has built a model to calculate BHP through acquisition of data including standpipe pressure, casing pressure (CP) and pump stroke combined with input of drilling fluid property data and borehole structure. In accordance with the principle to keep BHP constant, standpipe pressure (SPP) is changed by adjusting casing pressure (CP) to maintain constant BHP, which provides a basis for BHP automatic control.

Therefore, the invention provides an automatic control system for BHP in UBD, Real time surveillance and calculation of BHP are carried out by computer automatic control system, which helps to accurately control the BHP within the pressure range required by UBD all the time.

In addition, the invention also provides an automatic control method for BHP in UBD. By using the method, real time tracking of the actual BHP variations can be conducted to guarantee the normal operation of UBD. The high adjusting accuracy of the method ensures the reliability and safety of UBD operation.

The invention targets at liquid phase UBD technology. The following formula is established based on the annular kinetics equilibrium conditions:

Bottom hole pressure (*BHP*)=standpipe pressure (*SPP*)+fluid column pressure in the drilling tools−circulating pressure loss in the drilling tools−drill bit pressure drop ①

Wherein:

a. standpipe pressure (SPP), acquired onsite in real time;

b. fluid column pressure in the drilling tools, calculated through hydraulic formula from input of static data such as borehole deviation, well depth, drilling fluid density, etc;

c. circulating pressure loss in the drilling tools, calculated through hydraulic formula based on drilling fluid flow rate converted from pump stroke data acquired onsite in real time, geometric configuration of drilling tool, drilling fluid properties (mud density, plastic viscosity, value j, value k);

d. drill bit pressure drop, calculated through hydraulic formula based on drilling fluid flow rate converted from pump stroke data acquired onsite in real time, drill bit nozzle size and drilling fluid properties.

In summary, BHP can be accurately estimated by combining standpipe pressure data and pump stroke data acquired onsite in real time with the static data including borehole deviation, well depth, geometric size and length of drilling tools, drill bit nozzle size, drilling fluid properties, etc.

To a specific drilling operation, the set BHP in UBD is known and can be set based on the specific parameters and conditions in drilling operation and the geological and structural characteristics such as formation pressure. When BHP is within the set value range, there will be a reasonable negative pressure between BHP and corresponding formation pressure, and UBD operation can be carried out safely in a normal way. When the BHP is not within the set value range, BHP can be kept within the set value range by adjusting standpipe pressure based on the above derivation.

The relation between standpipe pressure and casing pressure is as follows:

$$P_{Standpipe}=P_{friction\ drag\ in\ pipe}+P_{friction\ drag\ in\ annulus}+P_{nozzle\ pressure\ drop}+P_{casing\ pressure}+P_{fluid\ column\ pressure\ in\ annulus}-P_{fluid\ column\ pressure\ in\ pipe}.$$

Therefore, standpipe pressure can be changed by adjusting casing pressure so that BHP is controlled. Casing pressure adjustment can be controlled by adjusting the opening of throttle valve mounted on choke manifold.

Based on the above theory, the invention provides an automatic control system for bottom hole pressure (BHP) in the underbalance, drilling (UBD), comprising a data acquisition unit, a data processing unit, a control and execution unit, a data conversion and transmission unit, wherein:

(1) The data acquisition unit includes dynamic modeling data acquisition module and static data input module. The dynamic modeling data acquisition module includes pressure sensors provided in drilling operation system to collect standpipe pressure and casing pressure as well as pump stroke sensors to measure pump strokes of the mud pump. This module mainly controls sampling frequency, filters interference signals calculates the sum and average of acquired data, and transmits these data to data processing unit. The static data input module may input many parameters including borehole structure, drilling tool configuration, mud property and well depth through man-machine interface, and may also update said parameters in time. Data acquisition unit collects real time dynamic modeling data in UBD operation and converts the data, while data transmission unit transmits the converted data and static input data to data processing unit.

(2) The data processing unit includes computer (embedded computer, such as industrial control computer, is preferred), containing a processing module for BHP in UBD.

The dynamic data transmitted from data conversion and transmission unit are input into the processing module for BHP in The processing module for BHP in UBD processes all the above-mentioned dynamic and static data. The BHP in the underbalance drilling is calculated from the acquired standpipe pressure (SPP) and the calculated circulating pressure loss in the drilling tools and drill bit pressure drop as well as the fluid column pressure in the drill string, as Formula ① shown. The resulting BHP is then compared with the set pressure value of the system. In case that the BHP is higher or lower than the set pressure value, an instruction to regulate throttle valve opening will be issued and transmits to control and execution unit through data conversion and transmission unit.

(3) The control and execution unit includes throttle valve and its control module. When throttle valve control module receives the instruction to control throttle valve opening from data processing unit, it sends a control signal to the throttle valve to control its opening so as to limit the BHP within the set pressure range in real time. The throttle valve-controlling module also contributes to protecting the valve against being shut completely, which may result in choke-out of well.

(4) The data conversion and transmission unit includes A/D and D/A converters and I/O controllers and are used to convert, input and output system data. It converts the modeling data acquired by data acquisition unit into converted data through A/D converter, transmits the converted data to data processing unit through I/O controller. Further, it converts the data processed by data processing unit into modeling signals through D/A converter and sends the signals to control and execution unit through I/O controller.

In order to improve the automatic control system developed by the invention, the automatic control system is also equipped with an alarming system for the presence of excessive $H_2S$. That is to say, the data acquisition unit also includes $H_2S$ concentration detection sensor.

The data processing unit includes an alarm control module for the presence of excessive $H_2S$. The data acquisition unit inputs the dynamic data of $H_2S$ concentration into the alarm control module for the presence of excessive $H_2S$. The alarm control module compares the actually detected concentration with the set concentration of the system and sends an alarm triggering instruction to the control and execution unit if the actually detected concentration is higher than the set concentration value.

The control and execution unit includes an alarm for the presence of excessive $H_2S$. The alarm will be triggered upon receipt of such instruction from the data processing unit.

The automatic control system in the invention also includes an automatic igniter control system, which can ignite automatically when flammable gas concentration is higher than the upper limit, wherein:

The data acquisition unit includes flammable gas concentration detection sensor.

The data processing unit includes an igniter control module. The data acquisition unit inputs the dynamic data of flammable gas concentration into the igniter control module, and the igniter control module compares the actually acquired flammable gas concentration data with the set concentration value. An instruction of the presence of excessive flammable gas will be issued to the control and execution unit if the actually acquired concentration is higher than the set concentration value.

The control and execution unit also includes an igniter provided on the igniting line. The igniter will automatically ignite and burn the flammable gas upon receipt of the instruction of the presence of excessive flammable gas from the data processing unit.

The automatic control system of the invention also includes an automatic mud-dumping system for the skimming tank, wherein:

The data acquisition unit includes a liquid level gauge detecting the liquid level of the skimming tank.

The data processing unit includes a mud-dumping pump control module. Data acquisition unit inputs the dynamic data of the liquid level of the skimming tank into the mud-dumping pump control module, and the mud-dumping pump control module compares the liquid level of the skimming tank actually acquired with the set level. An instruction will be issued to start the mud-dumping pump to the control and execution unit if the actually acquired liquid level is higher than the set level value.

The control and execution unit also includes the mud-dumping pump provided on the skimming tank. The mud-dumping pump will be started to pump the drilling fluid in the skimming tank into the circulating tank of drilling fluid to maintain the normal operation of the drilling fluid circulating system for UBD upon receipt of such instruction from the data processing unit.

The automatic control system of the invention also consists of an automatic well kick and lost of well alarming system.

The data acquisition unit includes a liquid level gauge detecting the liquid level of the mud tank.

The data processing unit includes well kick and lost of well alarm control module. The data acquisition unit inputs the dynamic data of the liquid level of the mud tank into the Well kick and lost of well alarm control module, and then said alarm control module compares the actually acquired liquid level with the liquid level for the last time interval. An alarm triggering instruction will be sent to the control and execution unit if the fluctuation value of the liquid level is higher than the set value.

The control and execution unit includes well kick and lost of well alarm, which will be triggered upon receipt of such instruction from the data processing unit.

To facilitate onsite operation and offsite monitoring, the automatic control system of the invention also includes system configuration display unit, which includes computers, such as portable computers, containing data display module and communication module, etc. The system configuration display unit can act as the master computer to exchange data with the data processing unit, which may act as an industrial computer, through communication module and cable or wireless connection. The communication module can exchange data between the master computer and the industrial computer.

The original parameters of the static data are transmitted to data processing unit through communication module and its connection. Then, the system configuration display unit initializes those static data including borehole structure, drilling tool configuration, mud property and well depth and the like, and transmits updated data including well depth and drilling fluid property to the data processing unit at any time depending on drilling performance. Meanwhile, drilling monitoring video, onsite operation data and the resulting data transmitted back from the data processing unit are displayed in a dynamic way. In addition, the resulting data can be memorized in the system configuration display unit.

The pressure sensors, pump stroke sensors, liquid level gauges, igniter, alarms, throttle valves, throttle valve opening sensors involved in the automatic control system of the invention are available from the corresponding equipment used in current technology.

In relation to the automatic control system for BHP in UBD, the invention also provides an automatic control method for BHP in UBD, including a data acquisition process, a data processing process and a control and execution process, wherein:

(1) The data acquisition process includes the steps of inputting the static data and conducting real-time acquisition of the dynamic modeling data of standpipe pressure (SPP), casing pressure (CP) and mud pump stroke during drilling operation, and transmitting the acquired data to data processing process.

(2) The data processing process includes the steps of processing the static data including borehole structure, drilling tool configuration and mud property as well as the data acquired from data acquisition process. Based on the mechanism shown in Formula ①, the BHP in the underbalance drilling is calculated from the acquired standpipe pressure (SPP) and the calculated circulating pressure loss in the drilling tools and drill bit pressure drop as well as the fluid column pressure in the drill string. When the BHP is lower than the difference between the set pressure and the set pressure tolerance, an instruction to decrease throttle valve opening will be issued to increase casing pressure. After a delay period for pressure propagation, BHP is recalculated based on the newly changed standpipe pressure (SPP) and the dynamic and static data mentioned above. Then, the resulting BHP will be compared with the set value to determine if it is necessary to adjust the throttle valve opening again. This process will continue until the BHP is within the error allowance range of the set pressure value. When the BHP is higher than the sum of the set pressure and the error allowance, an instruction to increase throttle valve opening will be issued to reduce casing pressure. After a delay period for pressure propagation, BHP is recalculated based on the newly changed standpipe pressure (SPP) and other data. Again, the resulting BHP will be compared with the set value to determine if it is necessary to adjust the throttle valve opening again. This process will continue until the BHP is within the error allowance range of the set pressure value.

(3) The control and execution process includes the steps of sending control signals to electric control throttle valve to adjust throttle valve opening so as to limit the BHP within the set pressure range upon receipt of the instruction to control throttle valve opening from data processing process.

In order to improve the auto control method of the invention, the method also includes an automatic alarm method in case of excessive $H_2S$ exposure, wherein:

The data acquisition process includes the acquisition of the dynamic modeling data of $H_2S$ concentration.

The data processing process includes a comparison between the $H_2S$ concentration actually acquired from data acquisition process and the set concentration. An alarm triggering instruction will be issued if the actually acquired concentration is higher than the set concentration value.

The control and execution process described will trigger the alarm when it receives such instruction from data processing process.

The alarm means include all kinds of alarming modes in modern technology, such as sound and light alarm or computer beep and display alarm.

The automatic control method of the invention also includes an auto control method to automatically ignite and burn flammable gas when flammable gas concentration is higher than the upper limit, wherein:

The data acquisition process described includes the acquisition of dynamic modeling data of flammable gas concentration.

The data procession process includes a comparison between the flammable gas concentration actually acquired from data acquisition process and the set concentration. An instruction of the presence of excessive flammable gas will be issued if the actually acquired concentration is higher than the set concentration value.

The control and execution process described includes triggering the igniter to burn the excessive flammable gas upon receipt of the instruction of the presence of excessive flammable gas.

The automatic control method in the invention also includes an automatic mud-dumping method for mud-dumping pump.

The data acquisition process includes the acquisition of dynamic modeling data of the liquid level of the skimming tank.

The data processing process described includes a comparison between the liquid level of the skimming tank actually acquired from data acquisition process and the set level, an instruction to start the mud-dumping pump will be issued if the actually acquired liquid level is higher than the set level value.

The control and execution process described includes starting the mud-dumping pump to pump the drilling fluid in the skimming tank into the circulating tank of drilling fluid to maintain the normal operation of the drilling fluid circulation system for UBD upon receipt of such instruction from data processing process.

The automatic control method of the invention also includes an automatic well kick and lost of well alarm method based on the liquid level fluctuation of the mud tank.

The data acquisition process described includes the acquisition of the dynamic modeling data of the liquid level of the mud tank.

The data processing process described includes a comparison between the liquid level of the mud tank actually acquired and the liquid level in last time interval, and an alarm triggering instruction will be issued if the liquid level fluctuation value is higher than the set value. That is to say, a lost of well alarm instruction will be issued if the liquid level acquired in real time is lower than the liquid level in last time interval and the fluctuation value is higher than the set value. And a well kick alarm instruction will be issued if the liquid level acquired in real time is higher than the liquid level in last time interval and the fluctuation value is higher than the set value.

The control and execution process described also includes triggering the well kick and lost of well alarm upon receipt of such instruction from data processing unit.

To facilitate onsite operation and offsite monitoring, the automatic control method described in the invention also includes system configuration display process. The system configuration display process includes the steps of: initializing the static data acquired from data processing process, transmitting updated data including well depth and drilling fluid property to data processing process at any time depending on drilling performance, meanwhile, transmitting back the data resulted from data processing process, displaying the drilling monitoring video and onsite operation data in a dynamic way and memorizing the data.

The automatic BHP control system and method for UBD operation in this invention can work along with all kinds of rotary blowout preventers (special equipment for UBD) in the world. They not only improve the level of automation in the underbalance drilling process, but also enhance the accuracy, reliability and safety of underbalance drilling operation, which make them widely applicable.

DETAILED DESCRIPTION

Detailed description of the invention will be as follows along with the drawings.

Figure 1:
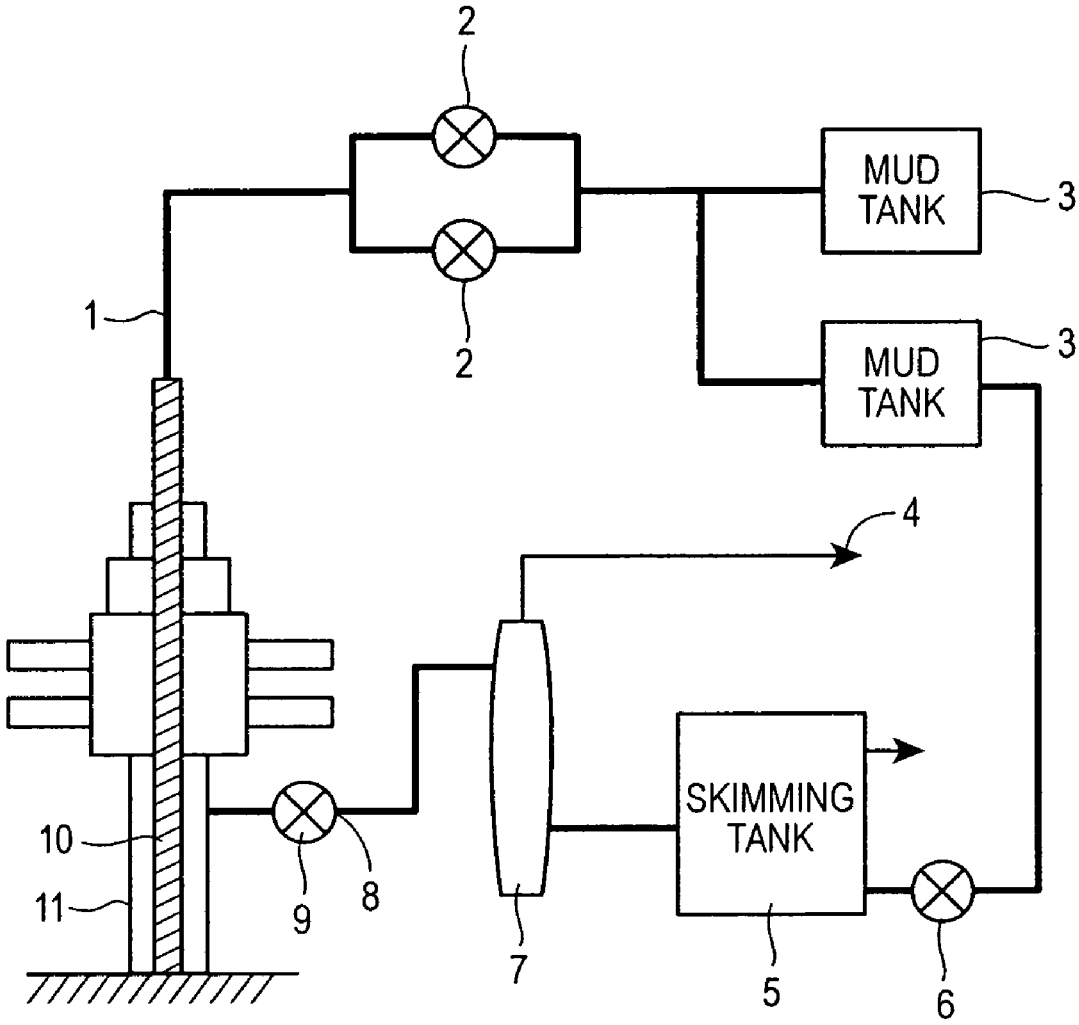
FIG. 1 shows a schematic view of the layout of the components of UBD system.
Figure 2:
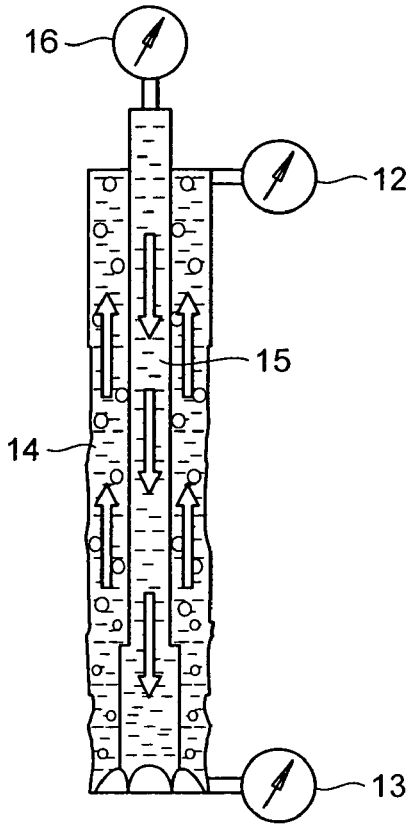
FIG. 2 shows a schematic view of the actual condition of the fluid pressure in drilling pipe and the annulus.
Figure 3:
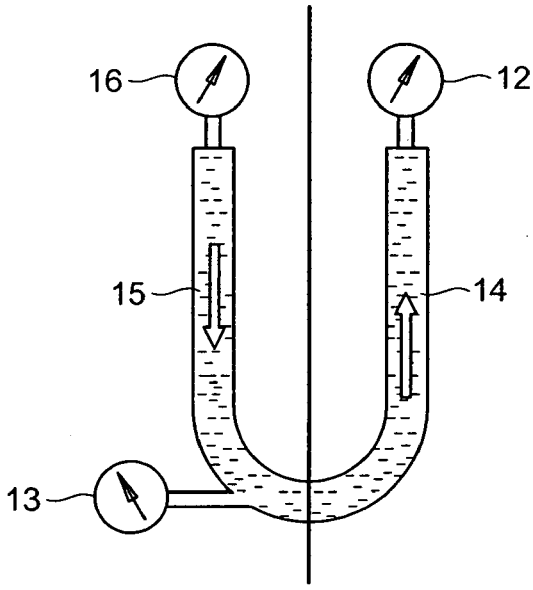
FIG. 3 shows a schematic view of the kinetic equilibrium pattern of the annulus.

FIG. 1 shows the main components of the drilling system. Drilling fluid is injected into drilling pipe 10 for UBD and multiphase fluid returns from casing 11. The standpipe pressure sensor 1 mounted on drilling pipe 10 can measure real time standpipe pressure and transmit these data to the automatic control system. The multiphase fluid in casing 11 flows into gas-liquid separation tank 7 through choke manifold 8. The throttle valve 9 in choke manifold 8 can be used to adjust its opening following an instruction from the automatic control system so as to control casing pressure. The casing pressure sensor equipped with the throttle valve can measure the dynamic modeling data of casing pressure and transmit these data to the automatic control system. The fluids returned from casing 11 are separated in the gas-liquid separation tank 7. Gas is discharged from the top of the gas-liquid separation tank 7. The $H_2S$ concentration sensor and inflammable gas concentration sensor mounted on gas outlet line measure the real time data of gas concentration and transmit these data to the automatic control system. The igniter mounted on the igniting line 4 for gas discharging ignites and burns the inflammable gas automatically when it receives the igniting instruction from the automatic control system. The liquid discharged from the gas-liquid separation tank 7 is settled in the skimming tank 5. The oil in the liquid will be removed from the surface of the liquid. The liquid level gauge mounted on skimming tank 5 measures the real time liquid level data and transmits these data to the automatic control system. Mud-dumping pump 6 can start automatically to pump the mud into mud tank 3 upon receipt of such instruction from the system. The liquid level gauge of the mud pump mounted on mud tank 3 measures the real time data of liquid level and transmits these data to the automatic control system. Mud tank 3 injects mud into drilling pipe 10 through mud pump 2. The pump stroke sensor is equipped along with mud pump 2 to measure the real time data of pump stroke and transmits these data to the automatic control system.

Figure 4:
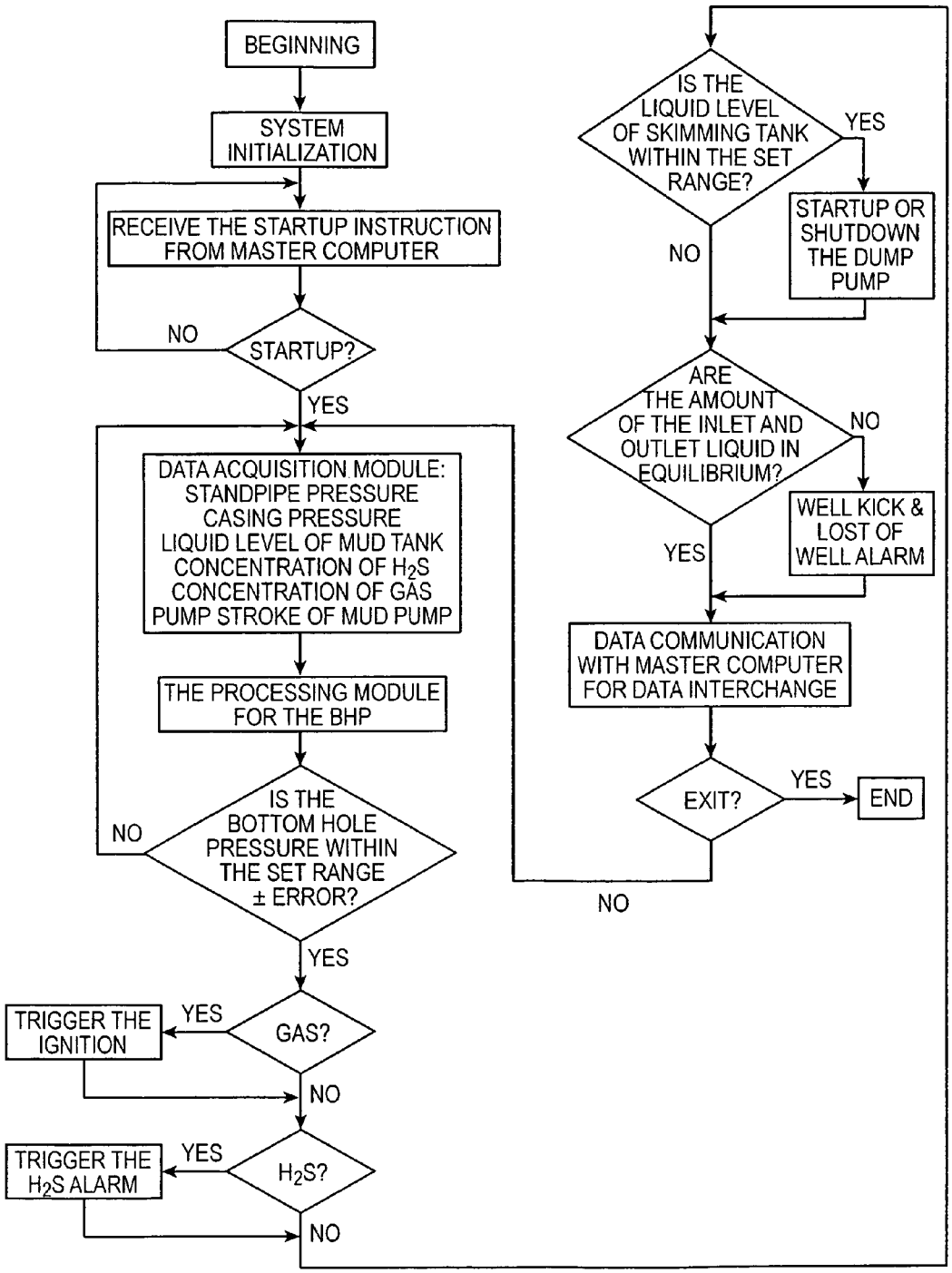
FIG. 4 shows a flow chart of the automatic control system for the bottom hole pressure.

FIG. 4 is the flow chart of the control system for bottom hole pressure.

The main tasks of initializing the startup system of the industrial computer are to communicate with the master computer, receive the working data including borehole structure, drilling tool configuration, drilling fluid properties and well depth, etc, as well as the control data such as equipment startup and their operation modes. Upon receipt of the startup instruction, the system begins to boot the data acquisition unit, which collects data in designated time, such as standpipe pressure, casing pressure, liquid level of mud tank and skimming tank, $H_2S$ concentration, natural gas concentration, pump stroke, etc. Then the system boots the bottom pressure processing module, which calculates BHP from acquired dynamic and static data by using Formula ①. After that throttle valve control module is booted to control throttle valve opening in order to maintain the BHP within the set pressure range.

After controlling the BHP, the system estimates the acquired, concentration of natural gas and triggers the igniter if the concentration is higher than the set value. Then the system estimates the acquired concentration of $H_2S$ and triggers the alarm for the presence of excessive $H_2S$ if the concentration is higher than the set value. Subsequently, the system estimates the acquired liquid level data of the skimming tank. When the acquired liquid level data is not within the range of set value, the system will start the mud-dumping pump if the acquired liquid level value is more than the set upper limit, or shut down the mud-dumping pump if the acquired liquid level value is less than the set lower limit. Then the system judges if the amount of inlet and outlet liquid are in equilibrium by the acquired liquid level of the mud tank. It will trigger the well kick and lost of well alarm if the liquid level fluctuation value between the actually acquired liquid level and the liquid level in last time interval is higher or lower than the set value. The system will communicate and exchange data with the master computer and transmit the related results or data to be displayed to the master computer. Finally, data acquisition unit will be in control again and next cycle begins.

Figure 5:
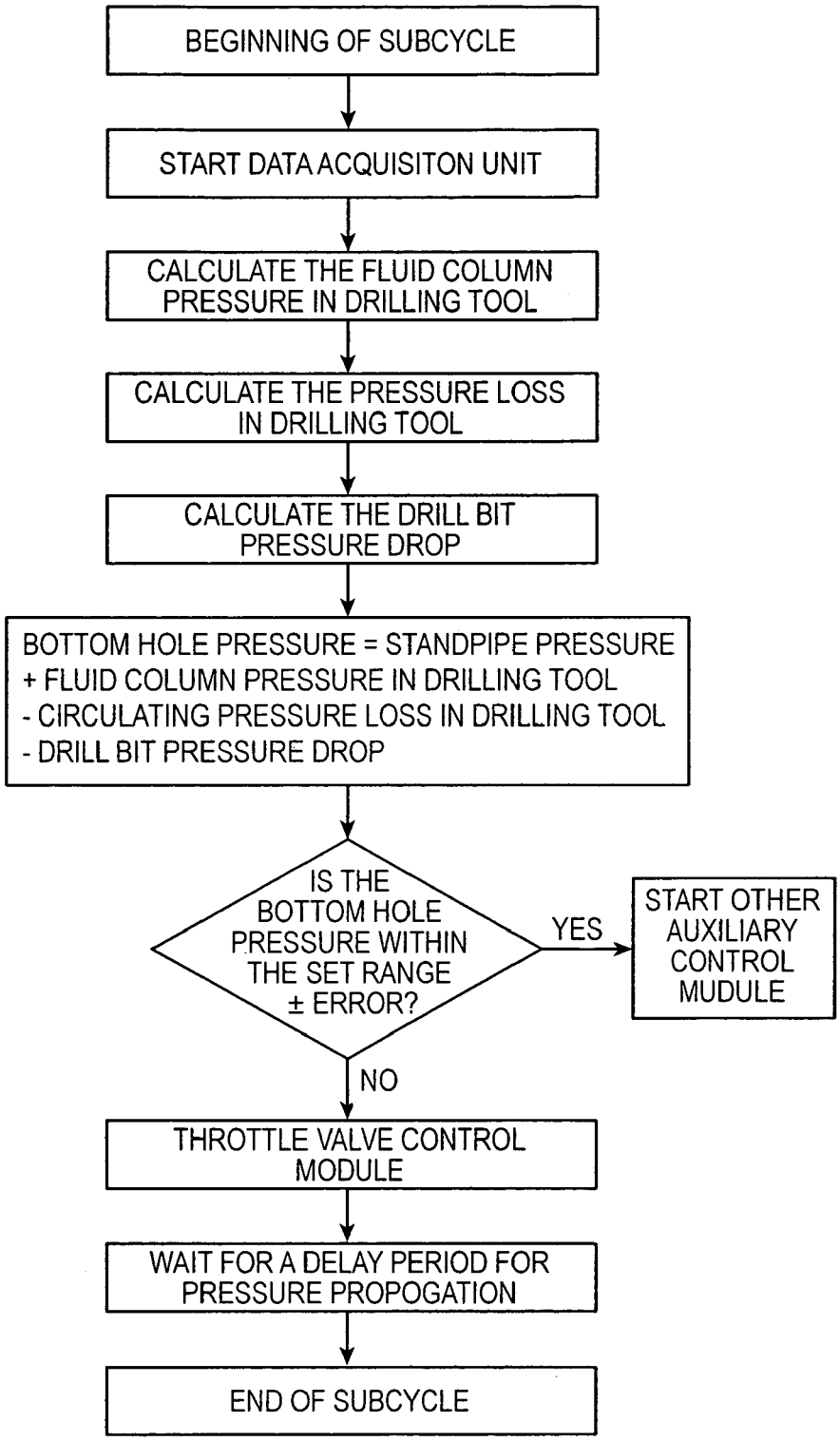
FIG. 5 shows a flow chart of the processing module, for bottom hole pressure in UBD.

FIG. 5 is the flow chart of the processing module for the bottom hole pressure.

As shown in FIGS. 5, first of all, the system calculates the fluid column pressure and circulating pressure loss in the drilling tools and drill bit pressure drop from the acquired real time data and static data. And then the system will have a judgment according to the BHP value calculated from the acquired standpipe pressure on the basis of the above data. The system exits from the module directly if the calculated BHP value is in the range of (the set value±error), i.e., the calculated BHP value is between (the set value−error) and (the set value+error). The system will boot throttle valve control module if the calculated BHP value is not within the range of (the set value+error). The throttle valve control module adjusts throttle valve opening (increasing the opening when BHP value>the set value or reducing the opening when BHP value<the set value) according to the special arithmetic. Thereby the casing pressure will increase or reduce, and leads to the corresponding variation of standpipe pressure.

The system then enters into a stand-by period, boots the data acquisition unit after a delay period for pressure propagation and recalculates the BHP value from the acquired data. The system exits the module directly if the calculated BHP value is within the range of (the set value±error), and boots throttle valve control module for further adjustment until the calculated BHP value is within the range of (the set value±error) if the calculated BHP value is not within the range of (the set value±error).

The invention is claimed:

1. An automatic control system for bottom hole pressure (BHP) in underbalanced drilling (UBD) comprising a data acquisition unit, a data processing unit, a control and execution unit, and a data conversion and transmission unit, wherein:

(1) the data acquisition unit comprises a dynamic modeling data acquisition module and a static data input module, the dynamic modeling data acquisition module including pressure sensors provided in a drilling operation system to collect standpipe pressure and casing pressure, and pump stroke sensors to collect pump strokes of the mud pump, the static data input module for inputting parameters including borehole structure, drilling tool configuration, mud property, and well depth through man-machine interface;

(2) the data processing unit comprises a processing module for the BHP in the underbalanced drilling, the module processing parameters including all the dynamic and static data, and the BHP in the underbalanced drilling calculated from an acquired standpipe pressure (SPP), a calculated circulating pressure loss in the drilling tools, a drill bit pressure drop and a fluid column pressure in the drill string, the BHP calculated by deducting the circulating pressure loss in the drilling tools and the drill bit pressure drop from the sum of the standpipe pressure (SPP) and the fluid column pressure in the drilling tools, then the resulting BHP is compared with a set pressure of the system, and an instruction to regulate a throttle valve opening is issued when the BHP is higher or lower than the set pressure;

(3) the control and execution unit comprising a throttle valve and a throttle valve control module, the throttle valve control module sending a control signal to the throttle valve to control the opening thereof when receiving an instruction to control the throttle valve opening from the data processing unit, to limit the BHP within the set pressure range in real time;

(4) the data conversion and transmission unit for transmitting the dynamic modeling data and the static input data in the underbalanced drilling operation acquired in real time by the above mentioned data acquisition unit to the data processing unit, or transmitting the instruction of regulating the throttle valve opening to the control and execution unit.

2. The automatic control system of claim 1 wherein the data acquisition unit includes a $H_2S$ concentration detection sensor;

the data processing unit includes an alarm control module for the presence of excessive $H_2S$, and the data acquisition unit inputs a dynamic data of $H_2S$ concentration into the alarm control module for the presence of excessive $H_2S$, which compares an actually detected concentration with a set concentration of the system and sends an instruction to the control and execution unit to trigger the alarm when the actually detected concentration is higher than the set value;

the control and execution unit includes an alarm for the presence of excessive $H_2S$, and the alarm is triggered upon receipt of such instruction from the data processing unit.

3. The automatic control system of claim 1 wherein the data acquisition unit includes a flammable gas concentration detection sensor;

the data processing unit includes an igniter control module, and the data acquisition unit inputs a dynamic data of flammable gas concentration into the igniter control module, which compares an actually detected concentration with a set concentration of the system and sends an instruction of a presence of excessive flammable gas to the control and execution unit when the actually detected concentration is higher than the set value;

the control and execution unit includes an igniter provided on an igniting pipeline, and the igniter automatically ignites and bums flammable gas when it receives an instruction of a presence of excessive flammable gas from the data processing unit.

4. The automatic control system of claim 1 wherein the data acquisition unit includes a liquid level gauge for measuring a liquid level of a skimming tank;

the data processing unit includes a mud-dumping pump control module, and the data acquisition unit inputs a dynamic data of the liquid level of the skimming tank into the mud-dumping pump control module, which compares the actually acquired liquid level data with a set value and sends an instruction to the control and execution unit to start the mud-dumping pump when the acquired liquid level is higher than the set value;

the control and execution unit includes a mud-dumping pump provided on the skimming tank, the mud-dumping pump is started to pump a drilling fluid in the trimming tank into a circulating tank of the drilling fluid to maintain a normal operation of an underbalance circulating system of drilling fluid upon receipt of an instruction to start the mud-dumping pump from the data processing unit.

5. The automatic control system of claim 1 wherein the data acquisition unit includes a liquid level gauge for measuring a liquid level of a mud tank;

the data processing unit includes a well kick and lost of well alarm control module, and a data acquisition unit inputs dynamic data of the liquid level of the mud tank into the well kick and lost of well alarm control module, which compares the actually acquired liquid level with a liquid level for the last time interval and sends an alarm triggering instruction to the control and execution unit when the fluctuation value of the liquid level is higher than a set value;

the control and execution unit includes a well kick and lost of well alarm, which is triggered upon receipt of such instruction from the data processing unit.

6. The automatic control system of claim 1 wherein said automatic control system further comprises a system configuration display unit, which includes a data display module and a communication module, and the system configuration display unit exchanges data with the data processing unit through a communication module, and wherein after the original parameters of the static data are transmitted to the data processing unit through communication module and its connection, the system configuration display unit initializes the static data and transmits updated data including well depth and drilling fluid property to the data processing unit at any time depending on drilling status, while drilling monitoring video, onsite operation data, and the resulting data transmitted back from the data processing unit are displayed in a dynamic way and are memorized.

7. An automatic control method for bottom hole pressure (BHP) in the underbalanced drilling, said method comprising a data acquisition process, a data processing process, and a control and execution process, wherein (1) the data acquisition process includes: inputting static data and conducting real-time acquisition of dynamic modeling data of standpipe pressure (SPP), casing pressure (CP), and mud pump stroke during drilling operation, and transmitting the acquired data to the data processing process;

(2) the data processing process includes: processing the static data including borehole structure, drilling tool configuration, and mud property, as well as the dynamic data acquired from data acquisition process, and calculating the BHP in the underbalanced drilling upon the acquired standpipe pressure (SPP) and the calculated circulating pressure loss in the drilling tools and drill bit pressure drop, as well as the fluid column pressure in the drill string, the BHP calculated by deducting the circulating pressure loss in the drilling tools and the drill bit pressure drop from the sum of the standpipe pressure (SPP) and the fluid column pressure in the drilling tools and issuing an instruction to decrease throttle valve opening to increase casing pressure value when the resulting BHP is lower than (the set pressure value-the error allowance), recalculating the BHP upon the newly changed standpipe pressure (SPP)

and the dynamic and static data mentioned above after a delay period for pressure propagation, then comparing the resulting BHP with a set value to determine whether it is necessary to adjust the throttle valve opening again, and then continuing this process until the BHP is within the range of (the set pressure value±the error allowance); alternatively, issuing an instruction to increase throttle valve opening to reduce casing pressure value when the BHP is higher than (the set pressure value+the error allowance), recalculating the BHP upon the newly changed standpipe pressure (SPP) and other data after a delay period for pressure propagation, then comparing the resulting BHP with the set pressure value to determine if it is necessary to adjust the throttle valve opening again, and then continuing this process until the BHP is within the range of (the set pressure value ±the error allowance);

(3) the control and execution process includes: sending control signals to an electric control throttle valve and adjusting a throttle valve opening upon receipt of the instruction to the control throttle valve opening from data processing process, to limit the BHP within the set pressure range in real time.

8. The method of claim 7 wherein the data acquisition process includes the step of collecting dynamic modeling data of $H_2S$ concentration;

the data processing process includes the steps of comparing the $H_2S$ concentration actually acquired in data acquisition process with a set concentration value, and issuing an alarm triggering instruction when the actually acquired concentration is higher than the set concentration value;

the control and execution process includes the step of triggering an alarm upon receipt of an instruction from the data processing process.

9. The method of claim 7 wherein the data acquisition process includes the step of collecting dynamic modeling data of a flammable gas concentration;

the data processing process includes the steps of comparing the flammable gas concentration actually acquired in the data acquisition process with a set concentration value, and issuing an instruction of a presence of excessive flammable gas when the actually acquired concentration is higher than the set concentration value;

the control and execution process includes the step of triggering an igniter to bum flammable gas upon receipt of an instruction of a presence of excessive flammable gas from the data processing process.

10. The method of claim 7 wherein the data acquisition process includes the step of collecting dynamic modeling data of a liquid level of a skimming tank;

the data processing process includes the steps of comparing the liquid level of the skimming tank actually acquired in a data acquisition process with a set liquid level, and issuing an instruction to start a mud-dumping pump when the actually acquired liquid level is higher than the set liquid level;

the control and execution process includes the steps of starting a mud-dumping pump to pump the drilling fluid in the skimming tank into a circulating tank of drilling fluid to maintain a normal operation of underbalance drilling fluid circulation system upon receipt of an instruction to start the mud-dumping pump from the data processing process.

11. The method of claim 7 wherein the data acquisition process includes the step of collecting dynamic modeling data of a liquid level in a mud tank;

the data processing process includes the steps of comparing an actually acquired liquid level data of the mud tank with a liquid level data for the last time interval and issuing an alarm triggering instruction when the fluctuation value of the liquid level is higher than a set value;

the control and execution process includes the step of triggering of a well kick and lost of well alarm upon receipt of an instruction from the data processing unit.

12. The method of claim 7 further comprising a system configuration display process, wherein the static data acquired from the data processing process are initialized, and updated data including well depth and drilling fluid property are transmitted to the data processing process at any time depending on drilling status, while the resulting data are transmitted back from the data processing process and a drilling monitoring video and onsite operation data are displayed in a dynamic way.

* * * * *